US009704672B1

(12) United States Patent
Sun

(10) Patent No.: US 9,704,672 B1
(45) Date of Patent: Jul. 11, 2017

(54) BACKLIT KEYBOARD

(71) Applicant: Szu-Wei Sun, Taoyuan (TW)

(72) Inventor: Szu-Wei Sun, Taoyuan (TW)

( * ) Notice: Subject to any disclaimer, the term of this patent is extended or adjusted under 35 U.S.C. 154(b) by 0 days.

(21) Appl. No.: 15/180,952

(22) Filed: Jun. 13, 2016

(30) Foreign Application Priority Data

Jan. 6, 2016 (TW) ..... 105100250 A

(51) Int. Cl.
*H01H 13/83* (2006.01)

(52) U.S. Cl.
CPC ..... *H01H 13/83* (2013.01); *H01H 2219/06* (2013.01); *H01H 2219/062* (2013.01)

(58) Field of Classification Search
CPC ..... H01H 13/83; H01H 2219/06; H01H 2219/062; H01H 2219/044; G02B 6/0055; G02B 6/0021; G02B 6/0068; G02B 6/0083
USPC ..... 200/5 A, 308, 310–314
See application file for complete search history.

(56) References Cited

U.S. PATENT DOCUMENTS 7,847,204 B2 * 12/2010 Tsai ..... G06F 3/0202 200/310
2014/0326589 A1 * 11/2014 Shiu ..... H01H 13/83 200/5 A
2015/0021151 A1 * 1/2015 Chen ..... H01H 13/83 200/5 A

* cited by examiner

*Primary Examiner* — Edwin A. Leon

(57) ABSTRACT

A backlit keyboard includes light guide plates; an opaque support plate including spaces each with the light guide plate disposed therein; a plurality of light emitting elements disposed on the concavity and embedded within the light guide plate; a circuit board secured onto the support plate to cover the light guide plates; keycaps above the circuit board and each including two limit members at two sides respectively; and a housing frame including openings each with the keycap slidably disposed thereon, and spacers each formed at either side of the opening of the housing frame. The spacer is fitting between two adjacent limit members that belong to each adjacent keycap and urges against the circuit board.

14 Claims, 9 Drawing Sheets

BACKLIT KEYBOARD

BACKGROUND OF THE INVENTION

1. Field of the Invention

The invention relates to lighted keyboards and more particularly to a backlight keyboard having improved characteristics including the provision of the light guide plate under the keycap, the compact arrangement of the support plate, the light guide plates and the light emitting element, the opaque support plate, the limit members being allowed to travel a limited distance, simplified components, simplified assembly steps, lowered keyboard height, decreased light travel path, the travel path of the keycap maintained at a right angle with respect to the bottom of the keyboard, increased light deflected by the light guide plates, and increased light reaching the bottom of the keycap.

2. Description of Related Art

A conventional backlight keyboard or keypad for use with a calculator, computer, or mobile phone includes a light guide plate, a reflective layer, and a shielding layer all assembled as a stacked component. Light emitted by a light source at a lower portion of the keyboard or keypad may pass through the stacked components to reach a bottom of a keycap.

However, the conventional backlight keyboard or keypad has the following disadvantages: The additional provision of the reflective layer to reflect light from the keycap. The additional provision of the scissors-type structures which increases thickness of the keyboard. Each key of the scissor-type structure on the circuit board must have a plurality of openings, so the brightness will leak light from the opening. The light must pass through multi-layers to the bottom of keycap. The light guide plates are sheet type and have the same size as the support plate which may increase the manufacturing cost and complicate the manufacturing processes.

Thus, the need for improvement still exists.

SUMMARY OF THE INVENTION

It is therefore one object of the invention to provide a backlight keyboard comprising at least one light guide plates; an opaque support plate including at least one concavity each with the light guide plate disposed therein; a plurality of light emitting elements, the light emitting elements being embedded within the light guide plate; a circuit board secured onto the support plate to cover the light guide plates; a plurality of keycaps disposed above the circuit board and each including at least one limit member at two sides respectively; and a housing frame including a plurality of openings each with the slidable keycap disposed thereon, and a plurality of spacers each formed at either side of the opening; wherein the spacer is fitting between two adjacent limit members that belong to each adjacent keycap and urges against the circuit board; and wherein in response to pressing the keycap, the limit members are configured to travel a vertical distance less than height of the spacer, and the light emitting elements are side emitted and embedded within the light guide plate, the light move forward the direction of light guide plate and diffusing light.

The above and other objects, features and advantages of the invention will become apparent from the following member detailed description taken with the accompanying drawing members.

BRIEF DESCRIPTION OF THE DRAWING MEMBERS

DETAILED DESCRIPTION OF THE INVENTION

Figure 1:
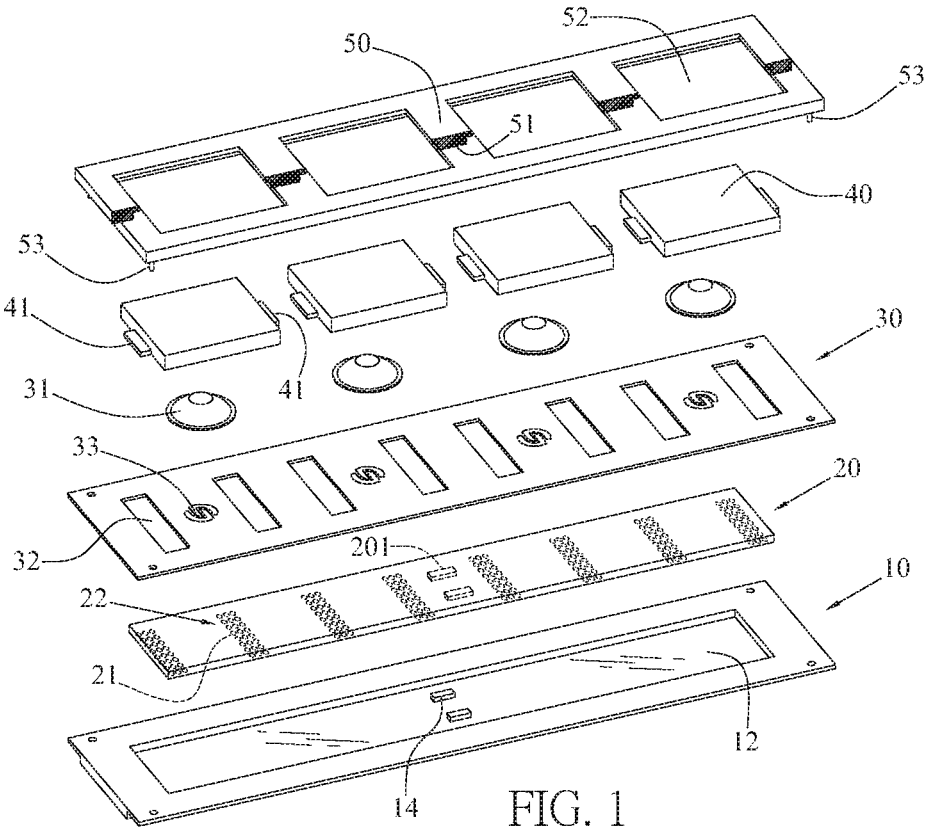
FIG. 1 is an exploded view of a backlight keyboard according to a first preferred embodiment of the invention.
Figure 2:
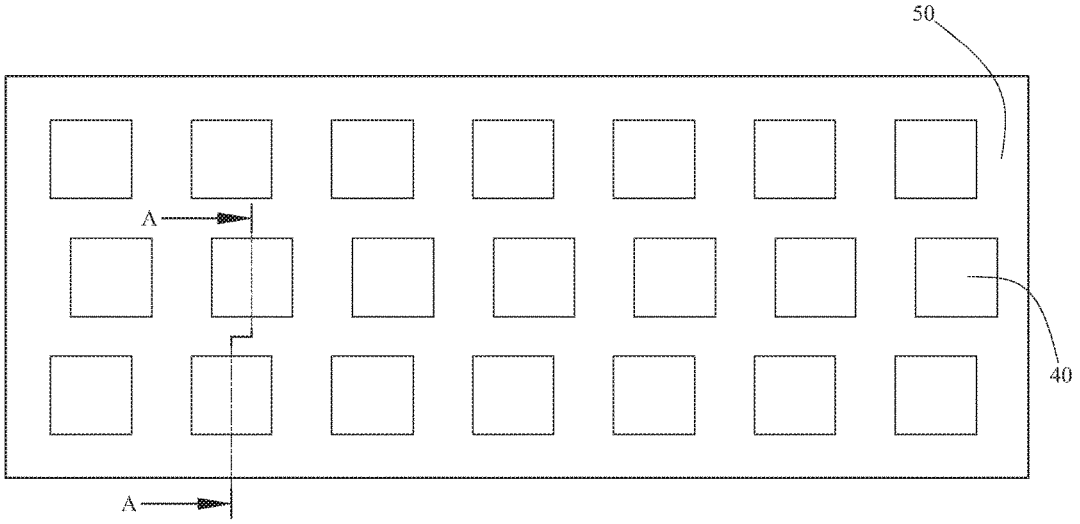
FIG. 2 is a top view of the assembled backlight keyboard.

Referring to FIGS. 1 to 3A, a backlight keyboard in accordance with a first preferred embodiment of the invention comprises the following components as discussed in detail below.

A plurality of reflective zones 22 are provided on a bottom of the light guide plate 20. The reflective zone 22 has a plurality of micro structures 21 or a plurality of white diffusive ink having a high reflection under the opening 32.

An opaque support plate 10 includes at least one space 11 each having a concavity 12 with the light guide plate 20 disposed therein, and two opposite light emitting elements 14 disposed on the concavity 12 and embedded within the light guide plate 20. An opaque circuit board 30 is secured onto the support plate 10 to cover the light guide plate 20. The circuit board 30 includes a plurality of openings 32, a plurality of sets of two electrical contacts 33 with each set of the electrical contacts 33 disposed between two adjacent openings 32, and a plurality of elastic members 31 each disposed above and around the electrical contacts 33.

A plurality of keycaps 40 urge against the elastic members 31 respectively. The keycap 40 includes two limit members 41 at two sides respectively. A housing frame 50 includes a plurality of openings 52 each with the keycap 40 disposed thereon, a plurality of spacer 51 each formed at either side of the opening 52 to make the keycap 40 move straight up and down and the spacer 51 can limit a vertical distance of the limit member 41 of the keycap 40, and a plurality of spacers set on side area or surface of the housing frame, at least one spacer have fasteners setting on the bottom, the fasteners 53 being driven through the circuit board 30 into the support plate 10 to fasten the housing frame 50, the circuit board 30, and the support plate 10 together. The limit members 41 of the keycap 40 slide straightly up and down between the housing frame 50 and the circuit board 30 through the spacers 51. Further, the elastic member 31 is pressed by the keycap 40. The limit members 41 are allowed to travel a vertical distance less than the height of the spacer 51 in response to pressing the keycap 40.

Preferably, the support plate 10 is made of metal or a white plastic.

Preferably, the light guide plate 20 is disposed on the concavity 12 of the support plate 10.

Preferably, the light guide plate 20 and the support plate 10 are formed integrally by secondary injection.

Alternatively, the micro structures 21 are replaced by a white diffusive ink having a high reflection 22.

Referring to FIGS. 1 to 3A and 5 to 7, in assembly of the invention the support plate 10 includes the concavity 12 having a white reflective layer 15 having a high reflection coated on the inner surface. The support plate 10 having the light emitting elements 14 is embedded within the light guide plate 20. The circuit board 30 is secured to top of the support plate 10 and the light guide plate 20. The circuit board 30 is opaque and includes at least one electrical contact 33 and openings 32 each between two adjacent electrical contacts 33. The elastic members 31 are disposed on top of the circuit board 30. Next, the keycaps 40 are installed. Each keycap 40 has an inner surface urging against the elastic member 31. Next, the housing frame 50 is mounted onto the keycaps 40 with the keycaps 40 passing through the openings 52 to be exposed. The spacer 51 is fitting between two adjacent limit members that belong to each adjacent keycap and urges against the circuit board 30. The fasteners 53 on four corners of the bottom of the housing frame spacer 51 are driven through the circuit board 30 into the support plate 10 to fasten the housing frame 50, the circuit board 30, and the support plate 10 together. A portion of the spacer 51 formed on the housing frame 50 urges against the limit members 41. The limit members 41 are allowed to travel a vertical distance less than the height of the spacer 51 in response to pressing the keycap 40. In a dark or low light environment, a user may press the keycap 40 to further press the elastic member 31 so that the elastic member 31 may contact the contact switches 33 to trigger a circuit (i.e., the circuit board 30 being activated). With the provision of the micro structures 21 or the reflective zones 22, the light may reach all portions of the bottom of the keycap 40 via the reflection of the light guide plate 20. As a result, the depressed keycap 40 is sufficiently lit to enable the user to clearly see the keycap 40.

Figure 3:
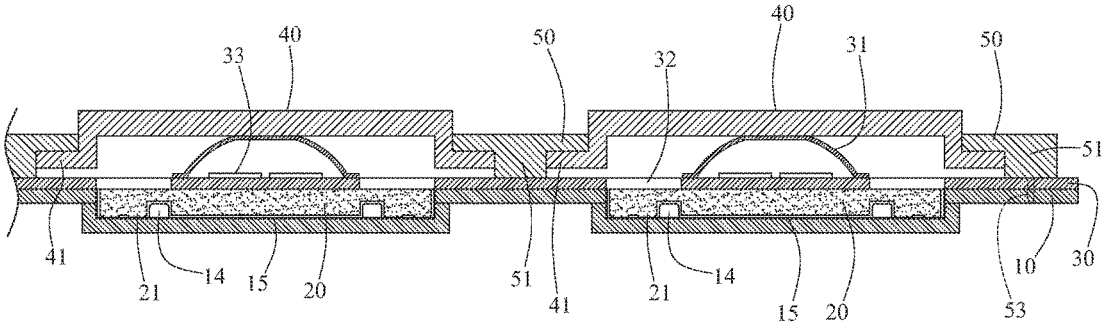
FIG. 3 is a sectional view taken along line A-A of FIG. 2.
Figure 3A:
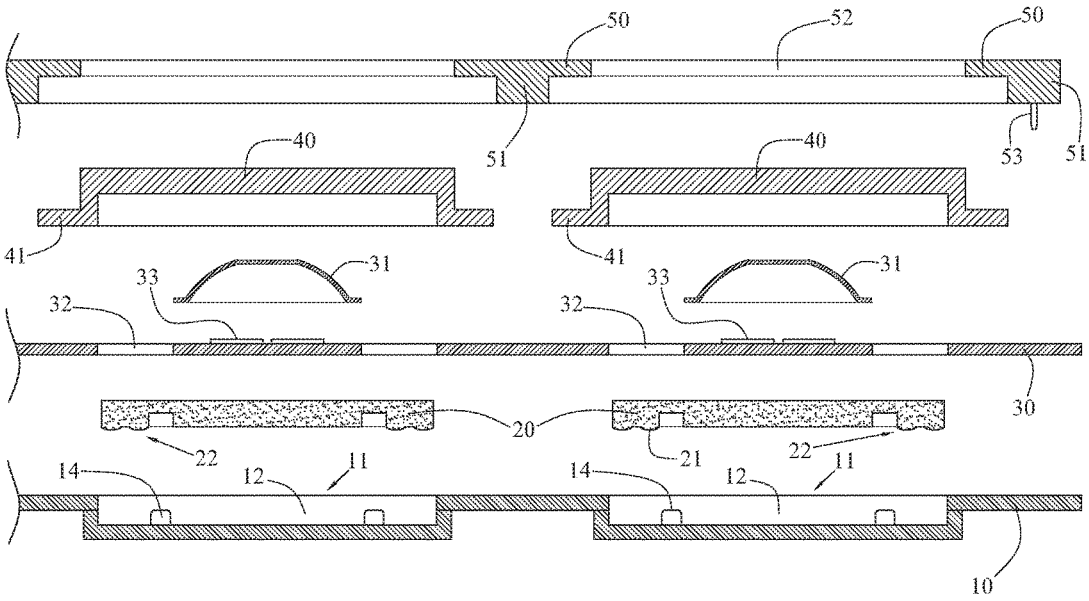
FIG. 3A is an exploded view of FIG. 3.
Figure 4:
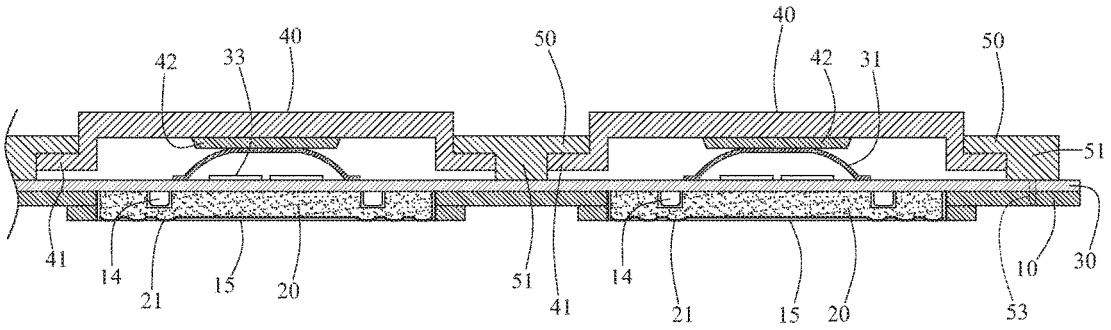
FIG. 4 is a longitudinal sectional view of a backlight keyboard according to a second preferred embodiment of the invention.
Figure 4A:
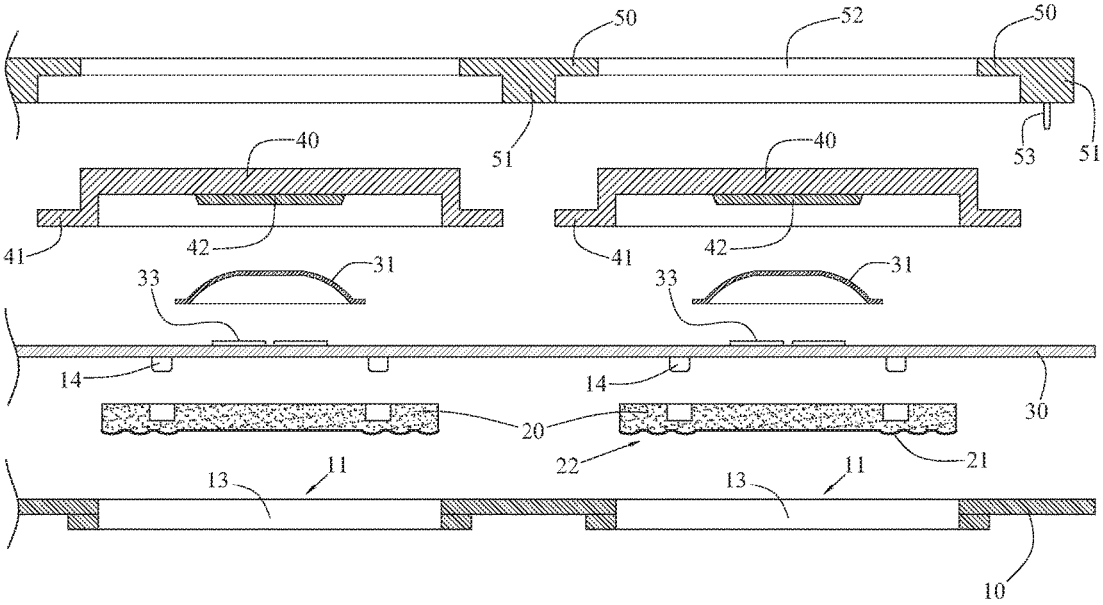
FIG. 4A is an exploded view of FIG. 4.

Referring to FIGS. 3A, 4 and 4A, a backlight keyboard in accordance with a second preferred embodiment of the invention is shown. The characteristics of the second preferred embodiment are substantially the same as that of the first preferred embodiment except the following member:

The circuit board 30 is transparent and thus no openings 32 are provided. The spaces 11 and concavities 12 are replaced by openings 13. The light guide plates 20 are provided in the openings 13. Bottom of the light guide plate 20 is disposed with white reflective layer 15 having a high reflection. An elastic element 42 is provided on a bottom of the keycap 40 and close the elastic member 31. The light emitting elements 14 are fitted in the concavities 12. Alternatively, the light emitting elements 14 are fitted on the bottom of the circuit board 30. Further, the light emitting elements 14 are embedded to spaces 201 within the light guide plate 20.

Preferably, the light guide plate 20 is disposed in the opening 13 of the support plate 10.

Preferably, the light guide plate 20 and the support plate 10 are formed integrally by secondary injection.

In a dark or low light environment, a user may press the keycap 40 to further press the elastic member 31 via the elastic element 42 so that the conductive elastic member 31 may contact the contact switches 33 to trigger a circuit (i.e., the circuit board 30 being activated). With the provision of the white reflective layer 15 having a high reflection, the light may reach all portions of the bottom of the keycap 40. As a result, the depressed keycap 40 is sufficiently lit to enable the user to clearly see the keycap 40.

Figure 5:
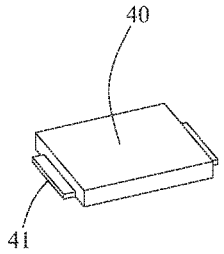
FIG. 5 is a perspective view of a first configuration of the keycap.

Referring to FIG. 5, in a first configuration of the keycap 40, two limit members 41 are provided on two sides respectively.

Figure 5A:
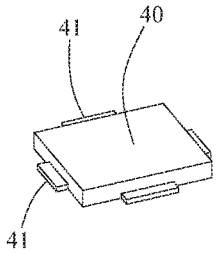
FIG. 5A is a perspective view of a second configuration of the keycap.

Referring to FIG. 5A, in a second configuration of the keycap 40, four limit members 41 are provided on four sides of the keycap 40 respectively.

Figure 5B:
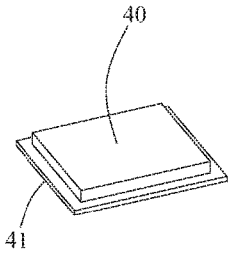
FIG. 5B is a perspective view of a third configuration of the keycap.

Referring to FIG. 5B, in a third configuration of the keycap 40, a single limit member 41 is provided on a periphery of the keycap 40.

Figure 5C:
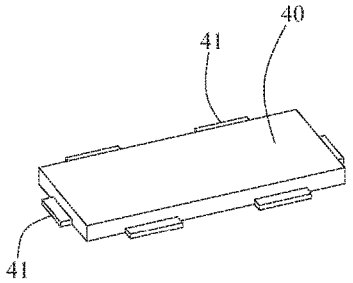
FIG. 5C is a perspective view of a fourth configuration of the keycap.

Referring to FIG. 5C, in a fourth configuration of the keycap 40, two limit members 41 are provided on two longer sides of the keycap 40 respectively, one limit members 41 are provided on the other end of the keycap 40 respectively.

Figure 6:
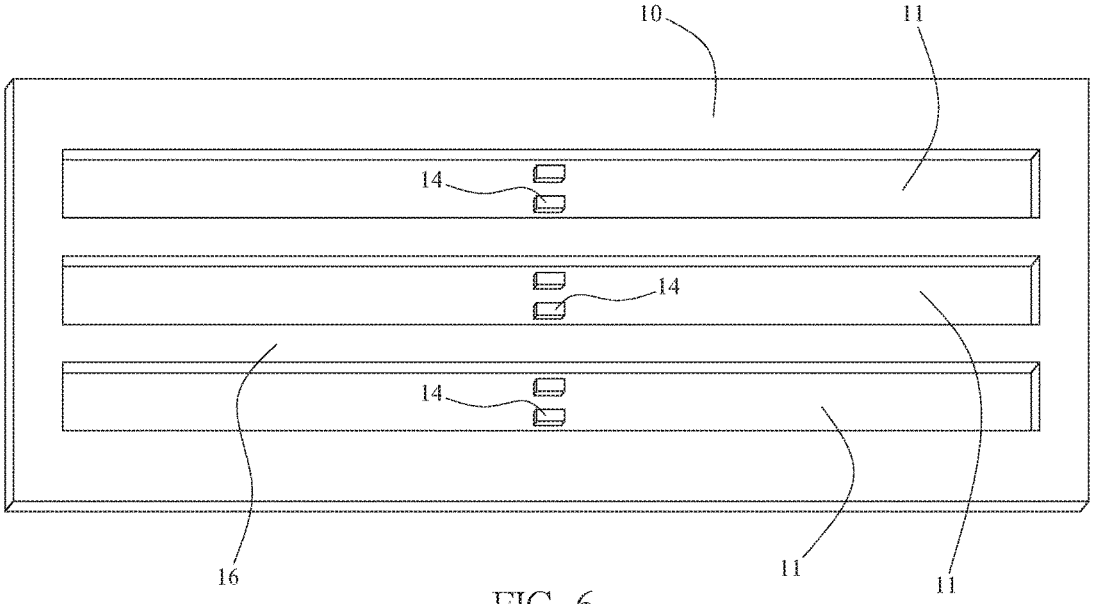
FIG. 6 is a top view of a first configuration of the support plate.

Referring to FIG. 6, a first configuration of the support plate 10 is shown. The space is divided into three spaces 11 by parallel walls 16 and three sets of two light emitting elements 14 are provided in the spaces 11 respectively.

Figure 7:
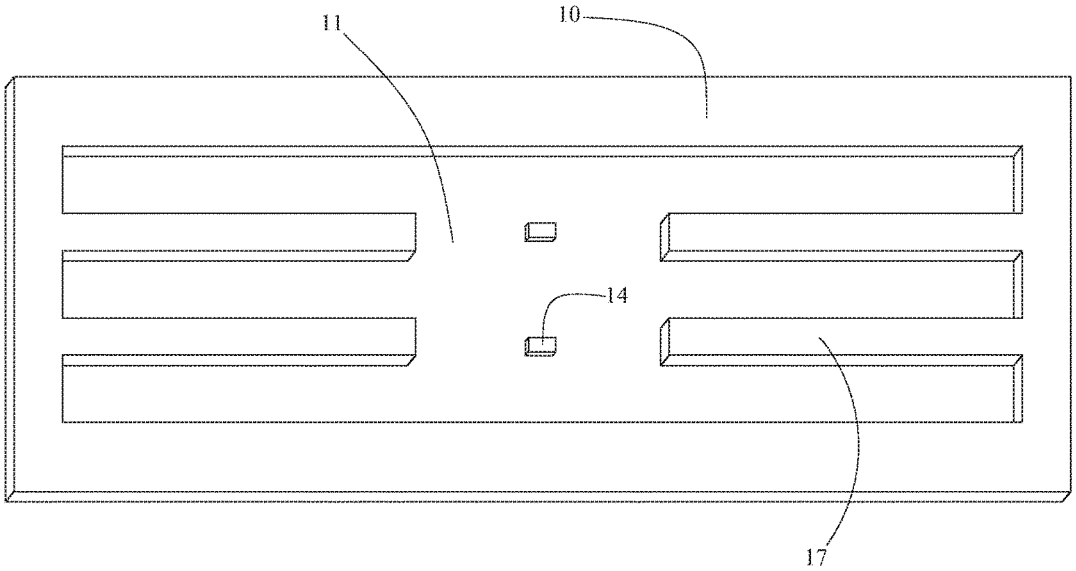
FIG. 7 is a top view of a second configuration of the support plate.

Referring to FIG. 7, a second configuration of the support plate 10 is shown. In the space 11, two side emitting elements provide opposite direction light to the space of light guide plate.

The invention has the following advantages: The conventional scissors-type structures for fastening the keycaps 40 are eliminated and thus no openings are provided through the circuit board 30 for disposing portions of the scissors-type structures. And in turn, the opening rate of circuit board 30 can be reduced. Leakage of light emitted by the light emitting element 14 is decreased to a minimum. The travel path of the keycap 40 is maintained at a right angle with respect to the bottom of the keyboard and the travel distance of the keycap 40 is limited at a distance less than the height of the spacer 51. The travel distance of the keycap 40 is further limited by the provision of the elastic element 42. The support plate 10 is opaque and together with the compact light guide plate 20 can decrease light path. The provision of the light guide plates 20 can concentrate and direct light onto the bottom of the keycap 40 for illumination. Finally, the keyboard can be made thinner.

While the invention has been described in terms of preferred embodiments, those skilled in the art will recognize that the invention can be practiced with modifications within the spirit and scope of the appended claims.

What is claimed is:

1. A backlit keyboard comprising:

at least one light guide plate;

an opaque support plate including at least one space each with the light guide plate disposed therein;

a plurality of light emitting elements embedded within the light guide plate;

a circuit board including a plurality of elastic members on a top, the circuit board secured onto the support plate to cover the light guide plates;

a plurality of keycaps each with the elastic member disposed therein and including at least one limit member; and a housing frame including a plurality of openings each with the keycap slidably disposed thereon, and a plurality of spacers each formed at either side of the opening to make the keycap move straight up and down and the spacer can limit a vertical distance of the limit member of the keycap;

wherein the spacer is fitting between two adjacent limit members that belong to each adjacent keycap and urges against the circuit board; and wherein in response to pressing the keycap, the limit members are configured to travel a vertical distance less than height of the spacer.

2. The backlit keyboard of claim 1, wherein each space of support plate includes at least a concavity with the light guide plate disposed therein.

3. The backlit keyboard of claim 1, wherein each space of support plate includes at least an opening with the light guide plate disposed therein.

4. The backlit keyboard of claim 1, wherein each keycap included at least an internal elastic element fastened therein.

5. The backlit keyboard of claim 1, wherein the circuit board is opaque and includes a plurality of openings each corresponding to the reflective zones formed on the light guide plate such that light emitted by the light emitting elements is configured to pass through the light guide plate to the bottom of the keycap.

6. The backlit keyboard of claim 1, wherein the limit member is disposed on a bottom of the keycap.

7. The backlit keyboard of claim 1, wherein the limit members are disposed on two sides of the keycap, or four limit members are provided on four sides of the keycap respectively.

8. The backlit keyboard of claim 1, wherein the spacers of housing frame further includes at least one fastener on a bottom thereof, the fasteners being either driven through the circuit board into the support plate to fasten the housing frame, the circuit board, and the support plate together.

9. The backlit keyboard of claim 1, wherein the support plate is made of metal or white plastic.

10. The backlit keyboard of claim 3, wherein a white reflective layer is disposed on side area of each opening or a bottom of the light guide plate when the support plate is metal.

11. The backlit keyboard of claim 2, wherein a white reflective layer is disposed on an inner surface of the concavity when the support plate is metal.

12. The backlit keyboard of claim 3, wherein a white reflective layer having a high reflection is disposed on a bottom of the light guide plate when the support plate is a white plastic.

13. The backlit keyboard of claim 1, wherein the light guide plate is disposed in the concavity of the support plate or the opening of the support plate.

14. The backlit keyboard of claim 1, wherein the light guide plate and the support plate are formed integrally by secondary injection.

* * * * *